United States Patent [19]

Olsen et al.

[11] Patent Number: 4,659,886

[45] Date of Patent: Apr. 21, 1987

[54] DISCONNECT SWITCH FOR A METAL-CLAD, GAS-INSULATED HIGH-VOLTAGE SWITCHGEAR

[75] Inventors: Willi Olsen; Dieter Lorenz; Hans-Peter Dambietz, all of Berlin, Fed. Rep. of Germany

[73] Assignee: Siemens Aktiengesellschaft, Berlin and Munich, Fed. Rep. of Germany

[21] Appl. No.: 871,653

[22] Filed: Jun. 6, 1986

[30] Foreign Application Priority Data

Jun. 14, 1985 [DE] Fed. Rep. of Germany ..... 3521945

[51] Int. Cl.[4] ..... H01H 33/60

[52] U.S. Cl. ..... 200/148 R; 200/148 B

[58] Field of Search ..... 200/148 B, 148 R, 148 H

[56] References Cited

U.S. PATENT DOCUMENTS

| | | | |
|---|---|---|---|
| 4,029,923 | 6/1977 | Meyer et al. | 200/148 B |
| 4,107,498 | 8/1978 | Van Berlyn | 200/148 B |
| 4,109,124 | 8/1978 | Boersma et al. | 200/148 R |
| 4,317,973 | 3/1982 | Van Berlyn | 200/148 F |

FOREIGN PATENT DOCUMENTS

| | | |
|---|---|---|
| 1590218 | 6/1970 | Fed. Rep. of Germany . |
| 2847376 | 9/1979 | Fed. Rep. of Germany . |
| 7802845 | 9/1978 | France . |
| 556610 | 11/1974 | Switzerland . |
| 1505485 | 3/1978 | United Kingdom . |

OTHER PUBLICATIONS

Brown Boveri Mitt., 11-79 publication, p. 701.

*Primary Examiner*—Robert S. Macon
*Attorney, Agent, or Firm*—Volker R. Ulbrich

[57] ABSTRACT

A disconnect switch, suitable for various conductor runs within a section of a metal-clad, gas-filled, high-voltage switchgear, with shielding bodies enclosing the ends of the conductors, is operated through a rotating insulator shaft that is perpendicular to the plane of the phase-current path of the section. One shielding body is made approximately in the shape of a sphere, whose center lies on the axis of the rotating insulator shaft and on the longitudinal axis of a movable switch contact. In the interior of the sphere there are one or more surfaces to accept a connecting means necessary for connection with the end of a first conductor. The mid-perpendiculars of each of the connection surfaces lie in the plane of the phase-current path. The isolating gap also lies in the path of an angled second conductor.

11 Claims, 5 Drawing Figures

DISCONNECT SWITCH FOR A METAL-CLAD, GAS-INSULATED HIGH-VOLTAGE SWITCHGEAR

FIELD OF THE INVENTION

This invention relates to a disconnect switch for a multi-pole section of a metal-clad, gas insulated high-voltage switchgear, in which each pole is situated in an enclosed housing terminating in two feedthrough insulators and having two conductors passing through the feedthrough insulators, each conductor having an end surrounded by and connected to a rounded hollow shielding body, which define the boundaries of the isolation gap.

BACKGROUND OF THE INVENTION

A disconnect switch, designed as a single-pole rectiliniar disconnect switch with hollow shielding bodies around each end of the two conductors, is known and described on page 701 of the Brown Boveri-Mitteilungen, 1979. In this known unit, a first hollow shielding body includes a movable contact contacting the end of a first conductor and being operable by means of a rotating insulator element. This rotating insulator element is inserted into the first shielding body and causes the opening and closing of the disconnect switch. The first shielding body also contains means for transforming the rotary motion of the rotating insulator element into the sliding opening and closing motions of the movable contact. When the disconnect switch is open, the isolation gap is defined by the boundaries of the two rounded shielding bodies. This known disconnect switch is an in-line disconnect switch; that is, the movable contact and the ends of the conductors that can be bridged by the movable contact all lie along a common axis. The enclosed housing is accordingly made in an approximately cylindrical shape and its end faces are closed by feedthrough insulators for the ends of the conductors.

In the sections of metal-clad, gas-insulated high-voltage switchgears, however, disconnect switches must be provided not only for in-line connected conductors, but must also be provided for right-angle or oblique-angle connected conductors, such as occur particularly at the connection between a terminal of a circuit breaker and bus bars. In-line and angular disconnect switches, as required, are used for these connections in conjunction with additional components such as straight or angular conduits, etc. of various designs.

SUMMARY OF THE INVENTION

It is an object of this invention to create a disconnect switch of such a design that, regardless of the angular relationship of the conductors, each pole of the disconnect switch inside the metal-clad housing always contains the same structural parts and has the shortest possible current-path length. It is a further object that the amount and the cost of internal parts and housings is kept to a minimum.

Briefly stated in accordance with one aspect of the invention, the aforementioned objects are achieved by providing a disconnect switch for use in a multi-pole section of a metal-clad, gas-insulated, high-voltage switchgear with each of the poles located within an enclosed housing terminating in two end faces with two feedthrough insulators and having two conductors passing through said feedthrough insulators, each conductor having an end surrounded by and connected to a rounded hollow shielding body with a distance between the shielding bodies defining the boundaries of an isolation gap, the first shielding body includes a movable contact contacting the end of the first conductor and beeing operable by means of a rotating insulator element to move from the first shielding body to bridge the isolation gap and contact the opposite end of the second conductor within the second shielding body which has the same longitudinal axis as the movable contact; the axis of the rotating insulator element being perpendicular to the longitudinal axis of the movable contact. The disconnect switch is characterized by the axis of the rotating insulator element being perpendicular to the plane of the phase-current path of the section, the first shielding body is approximately spherical in shape and has a center lying on the axis of the rotating insulator element and also lying on the longitudinal axis of the movable contact, said first shielding body has an interior surface and on said interior surface has at least one connection surface for receiving means for connecting with the end of the first conductor, and the mid-perpendicular of the connection surface lies in the plane of the phase-current path of the section.

By virtue of this embodiment having the rotating insulator element perpendicular to the plane of the phase-current path of the section and by virtue of having the design of the first hollow shielding body as a sphere whose center lies both on the axis of the rotating insulator and on the longitudinal axis of the movable contact piece, it is possible by turning the sphere about the rotating insulator element to alter the position of the movable contact, the mid-perpendicular of the connecting surface for the connection with the end of the first conductor remaining in the plane of the phase-current path. By virtue of the appropriate arrangement of the opposite end of the second conductor following this orientation, which opposite end lies in the second shielding body, the disconnect switch is adapted to various angled series of conductors without, in practice, any alteration in the electric field conditions or the dielectric strength in the region of the isolation gap, since the isolation gap turns in the same way. For various types of installation of the disconnect switch in various series of conductors, it is thus necessary only to have different kinds of metal-clad housings with the connecting sockets differently oriented; the internal structural parts of the disconnect switch, however, remain the same in every case. In this way, optimally short current-path lengths can be attained, since the isolating gap always lies in the angle conduit of the conductor path. Said special design of the disconnect switch not only is advantageous from the electrical standpoint, but also allows a favorable support mounting, since the number of differently designed disconnecting components is limited. Because the feedthrough insulators of the poles of the disconnect switch and the conductors passing through said feedthrough insulators are already at an angle to one another, they can in particular bridge directly the terminals of the circuit breaker to the bus bars without additional components.

In another embodiment of the invention, it is advantageous if the metal-clad housing, at least in the region adjacent to the sphere of the first shielding body, is partly spherical in shape with the same center. Then, when the sphere of the shielding body is turned in another direction, the emplacement of the spherical area of the enclosed housing is also appropriately altered, so that no distorting alteration of the electric field occurs in this region adjacent to the sphere of the first shielding body and the electric field and dielectric conditions are not worsened.

A further embodiment has a simplification of the support mounting which can be achieved when, in the interior of the sphere of the first hollow shielding body, there are provided several surfaces, set at angles to one another, for receiving the connecting means required for the connection with the end of the first conductor, the mid-perpendiculars of said surfaces each lying in the plane of the phase-current path of the section. In this case, the sphere of the first shielding body is already prepared for the connection of various series of conductors lying at desired angles to one another. All that is to do for the ultimate installation of the sphere is to prepare, on the exterior of the sphere, which is easily machinable, the necessary connecting surface for the end of the first conductor in accordance with the selected internal surface. In particular, it is expedient to provide, inside the sphere of the first shielding body, three surfaces next to one another and making an angle of 45° with another. In this way, various section configurations with different electrical circuits can be realized with the smallest possible space requirement.

Disconnect switch poles designed in such a fashion can be combined in an arbitrary manner in a multipole section as required. Thus it is expedient if, in a three-pole section, each of the associated disconnect switch poles or two of the associated disconnect switch poles have the isolating gap differently oriented to the axis of the first conductor.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
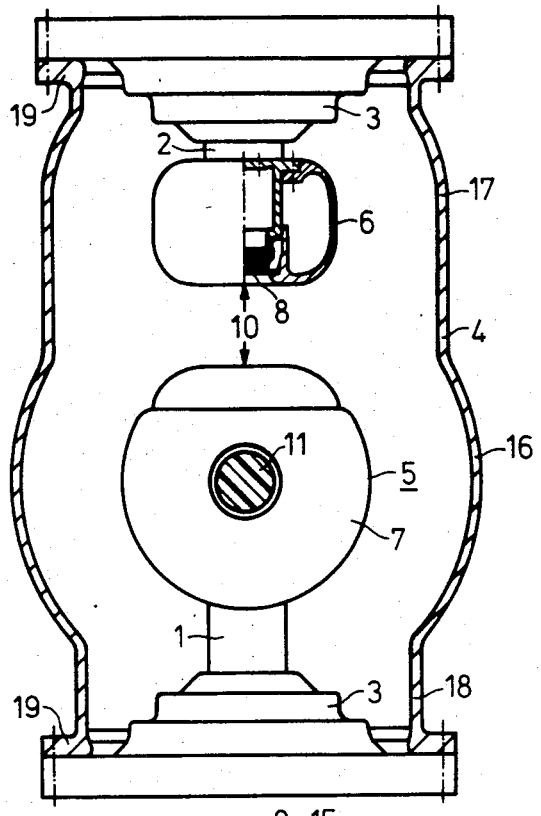
FIG. 1 shows a partial section of a disconnect switch in an in-line or 180° housing.

The disconnect switch in FIG. 1 is an in-line type switch; that is, the two ends of the first conductor 1 and of the second conductor 2 to be isolated or bridged-over lie on the same longitudinal axis. Both conductors 1, 2 are held by feedthrough insulators 3 in a central position with respect to the metalclad housing 4. The ends of the two conductors 1, 2 are furthermore enclosed by hollow rounded shielding bodies 5, 6, which act as field electrodes. The first shielding body 5, which is in contact with the end of the first conductor 1, is made in essentially the shape of a hollow sphere 7. The second shielding body 6 encloses the end of the conductor 2, which end forms a contact 8 with resilient fingers.

Figure 2:
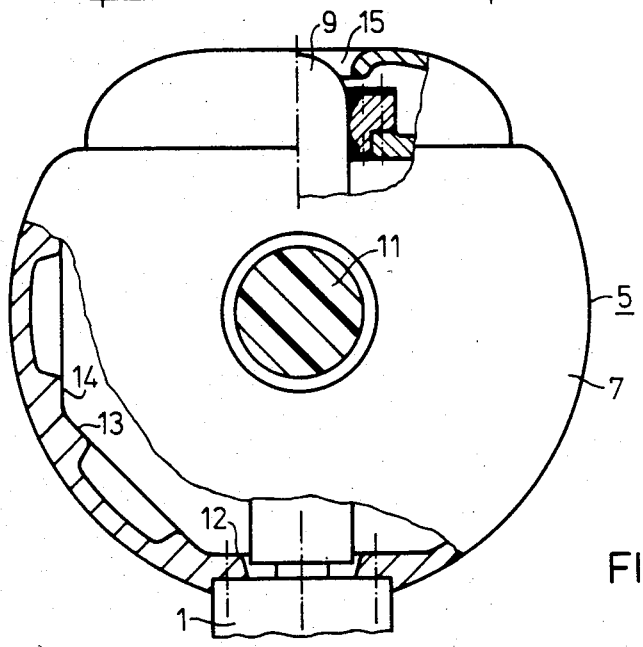
FIG. 2 shows a partially cut-away detailed view of the first shielding body as mounted in FIG. 1.

The hollow sphere 7 of the first shielding body 5 contains the movable contact 9 as shown in FIG. 2, which lies on the longitudinal axis of conductors 1, 2. With the disconnect switch in the open position, said movable contact 9 lies completely in the interior of the shielding body 5, so that the open isolating gap 10, indicated by the arrows in FIG. 1, is defined by the distance of the shielding bodies 5, 6.

The operation of the movable contact 9 in order to either close or open the isolating gap 10 is effected by a drive, which is not shown, lying outside the metal-clad housing 4. The drive connects to the movable contact 9 by means of a rotating insulator shaft 11 and transmission elements not shown. This rotating insulator shaft 11 is perpendicular to both the longitudinal axis of the conductors 1, 2 and to the plane of the phase-current path of the section, and is inserted into the shielding body 5. Also located in the interior of the shielding body 5 are the not shown means of transforming the rotary motion of this rotating insulator shaft 11 into the linear motion of the moving contact 9.

As shown in FIG. 2, in the interior of the hollow sphere 7 there are further provided three surfaces 12, 13, 14 lying next to each other and making an angle of 45° with one another. These internal surfaces 12, 13, 14 serve to accept the connecting means necessary for the connection with the end of the first conductor 1. The mid-perpendiculars, not shown, of these surfaces lie in the plane of the phase-current path of the section, which coincides with the plane of the paper in the FIGS. 1 and 2. In this way, the first shielding body 5 can be turned about the rotating insulator shaft 11 and, in each position, connected to the end of the conductor 1 through a connecting surface on the outside of the sphere 7, said connecting surface corresponding to one of the internal surfaces 12, 13 or 14. In this case, the position of the opening 15 for the movable contact 9 is shifted with respect to the end of the conductor 1 in such a way that the pole of the disconnect switch alone makes possible a differently configured conductor run. The configuration shown in FIGS. 1 and 2 corresponds to that of an in-line type disconnect switch in which the conductors 1 and 2 make an angle of 180° with each other.

The metal-clad housing 4 in the region adjacent to the sphere 7 has a spherical area 16, which is concentric with the sphere 7. In this manner, simple electric field conditions are produced in this region. The spherical area 16 joins up on each end with an approximately cylindrical connecting socket 17 and 18, respectively, which lead to respective flanges 19 of respective feedthrough insulators 3. The connecting socket 17 is longer than the connecting socket 18, since it also encloses the second shielding body 6.

Figure 3:
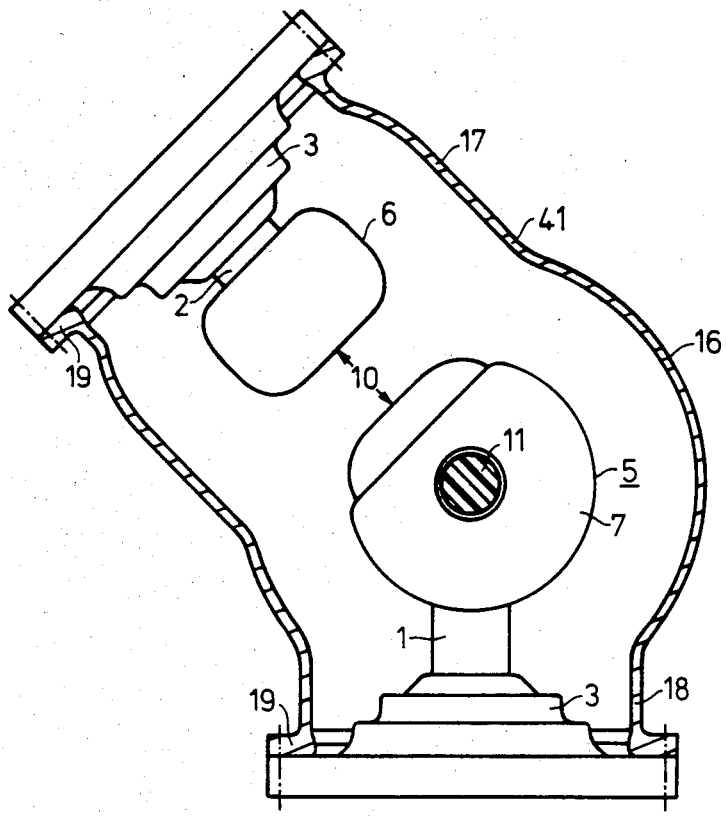
FIG. 3 shows a partial section of a disconnect switch in a 135° oblique angle housing.

FIG. 3 shows a disconnect switch with a different configuration of the first shielding body 5. The reference numbers in this figure are the same as for the previous configuration. Here the sphere 7 of the shielding body 5 is connected with the internal surface 13 (see FIG. 2) and the associated external connecting surface to the end of the conductor 1. In this way, the position of the opening 15 and that of the movable contact 9 are turned with respect to the conductor 1, the rotating insulator shaft 11 forming the axis of rotation. The end of the conductor 2 and the shielding body 6 enclosing it, are also arranged now in such a manner that the longitudinal axis of the conductor 2 corresponds to the longitudinal axis of the movable contact 9. Thus the position of the isolating gap 10 is also correspondingly altered.

Also altered in the same manner are the position of the connecting socket 17 of the metal-clad housing 41 and the region taken in by the spherical area 16 in this enclosed housing 41. Despite the altered directions of the conductors, i.e., conductors 1 and 2 now form an angle of 135° with each other, and the altered geometry of the metal-clad housing 41, however, the electric field conditions next the isolation gap 10 have remained practically unchanged.

Figure 4:
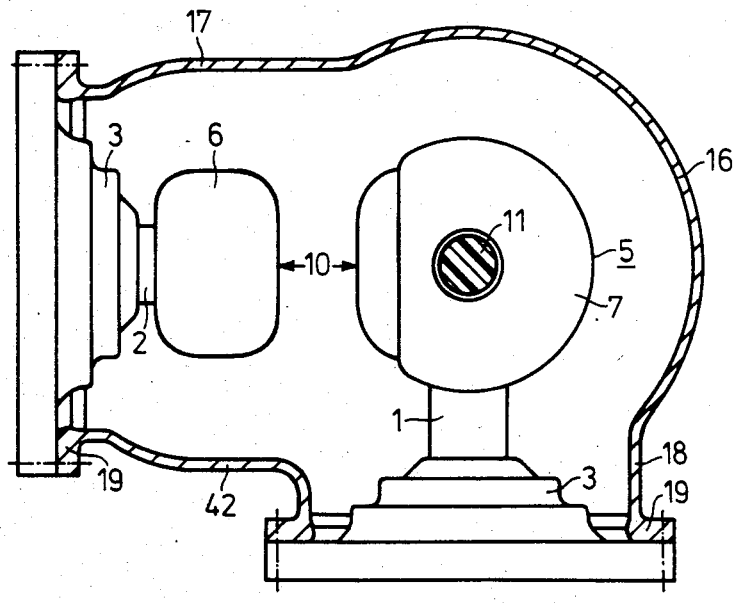
FIG. 4 shows a partial section of a disconnect switch in a 90° right angle housing.

Finally, FIG. 4 shows a disconnect switch in which the sphere 7 of the first shielding body 5 is connected to the end of the conductor 1 by means of the internal surface 14. As a consequence of the resulting turning of the movable contact 9 and the corresponding arrangement of the opposite end of the conductor 2 on the longitudinal axis of the movable contact 9, here a disconnect switch is obtained in which the conductors 1 and 2 make a right angle with each other. Here, again, the different parts of the metal-clad housing 42, namely the connecting socket 17, the spherical area 16 and the connecting socket 18, have been displaced relative to one another while the electric field conditions in the interior of the housing 4, in particular in the region of the isolation gap 10, have remained practically unchanged.

In all three of the various embodiments of the disconnect switch, the feedthrough insulator 3 for the end of the second conductor 2, which end is enclosed by the second shielding body 6, is always the same distance away from the center of the sphere 7 of the first shielding body 5, regardless of which of the internal surfaces 12, 13, 14 or the external connecting surfaces is employed in connecting the sphere 7 of the first shielding body 5 to the end of the first conductor 1. In this way, an optimally short current-path length is obtained.

Figure 5:
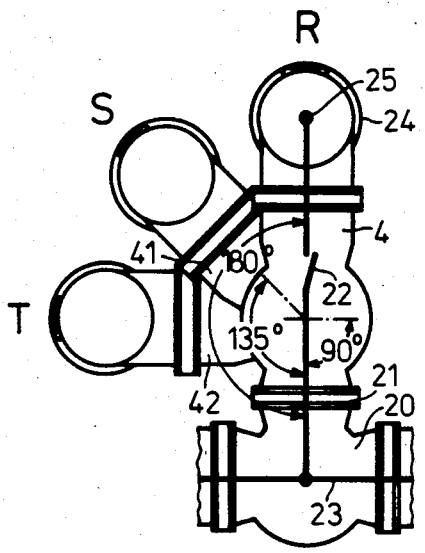
FIG. 5 shows a diagrammatic front view of a part of a section of a three-pole switchgear using metal-clad, gas-insulated, high-voltage disconnect switches.

FIG. 5 now shows a lateral view of a portion of a three-pole section of a metal-clad high-voltage switchgear with pressurized-gas insulation, in which disconnect-switch poles designed in accordance with the invention have been installed. The three phases R S T are in succession. The path of the conductors for phase R is shown as the circuit diagram. An angle housing 20 of the leading phase R is visible; on the central top flange 21 of the said angle housing, the metal-clad housing 4 of a disconnect-switch pole 22 designed in accordance with the invention is mounted by means of flanges. This disconnect-switch pole 22 connects the conductor 23 inside the angle housing 20 to the bus bar 25, located inside the connected enclosed housing 24, which is mounted on the metal-clad housing 4 by means of a flange. The disconnect-switch pole 22 in the section of phase R thus corresponds to the in-linetype disconnect-switch of FIG. 1, in which the two conductor ends form an angle of 180° with each other.

In the next succeeding phase S, the conductors of the disconnect-switch pole form an angle of 135° with each other, so that the disconnect-switch pole situated in the metal-clad housing corresponds to the disconnect-switch pole of FIG. 3. In phase T, finally, the disconnect-switch pole is located inside the enclosed housing 42 and connects two conductors making an angle of 90° with each other. Thus all the embodiments of the disconnect-switch poles find use within a three-phase section.

Although the housing geometries of the several disconnect-switch poles differ, the electric field conditions of the disconnecting system are practically the same in all the embodiments. Subsidiary to the connecting sockets shown, with the feedthrough insulators for the conductors, the enclosure housing of the disconnect switch may, however, have other connecting socket with flanges when this is necessary for mounting openings or for the connection of other components of the section.

It will now be understood that there has been disclosed an improved disconnect switch for a metal-clad, gas-insulated, high-voltage switchgear which can change the angular relationship of the two conductors of the switchgear without affecting the electrical characteristics of the disconnect switch and without resort to different structural parts inside the disconnect switch housing. As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States:

1. A disconnect switch for use in a multi-pole section of a metal-clad, gas-insulated, high-voltage switchgear with each of the poles located within an enclosed housing terminating in two end faces with two feedthrough insulators and having two conductors passing through said feedthrough insulators, each conductor having an end surrounded by and connected to a rounded hollow shielding body with a distance between the shielding bodies defining the boundaries of an isolation gap, the first shielding body includes a movable contacting the end of the first conductor and being operable by means of a rotating insulator element to move from the first shielding body to bridge the isolation gap and contact the opposite end of the second conductor within the second shielding body which has the same longitudinal axis as the movable contact; the axis of the rotating insulator element being perpendicular to the longitudinal axis of the movable contact, characterized by:

the axis of the rotating insulator element is perpendicular to the plane of the phase-current path of the section;

the first shielding body is approximately spherical in shape and has a center lying on the axis of the rotating insulator element and also lying on the longitudinal axis of the movable contact;

the first shielding body has an interior surface and on the interior surface has at least one connection surface for receiving means for connecting with the end of the first conductor; and the mid-perpendicular of the connection surface lies in the plane of the phase-current of the section.

2. A disconnect switch according to claim 1, further characterized by a region of the enclosed housing in which the first shielding body is located is partly spherical in shape and concentric with the approximately spherical first shielding body.

3. A disconnect switch according to claim 1, further characterized by:

a plurality of connecting surfaces within the hollow sphere of the first shielding body set at angles relative to one another, for receiving the connecting means required for the connection with the end of the first conductor; and the mid-perpendicular of each connecting surface lies in the plane of the phase-current path of the section.

4. A disconnect switch according to claim 3, further characterized by, three of said connecting surfaces lying next to one another and making an angle of 45° with one another.

5. A disconnect switch according to claim 3, further characterized by:

the feedthrough insulator for the second conductor, having an end which is surrounded by the second shielding body, being always the same distance away from the center of the approximately spherical first shielding body regardless of which of the plurality of connecting surfaces is used to connect said first shielding body to the end of the first conductor.

6. A disconnect switch for a multi-pole section according to claim 1, further characterized by:

the multi-pole switch is a three-pole switch;

at least two of the associated disconnect-switch poles have the isolation gap oriented differently relative to the axis of the first conductor.

7. A disconnect switch for use in a multi-pole section of ametal-clad, gas-insulated, high-voltage switchgear with each of the poles located within an enclosed housing terminating in two end faces with two feedthrough insulators and having two conductors passing through said feedthrough insulators, each conductor having an end surrounded by and connected to a rounded hollow shielding body with a distance between the shielding bodies defining the boundaries of an isolation gap, the first shielding body includes a movable contact contacting the end of the first conductor and being operable by means of a rotating insulator element to move from the first shielding body to bridge the isolation gap and contact the opposite end of the second conductor within the second shielding body which has the same longitudinal axis as the movable contact; the axis of the rotating insulator element being perpendicular to the longitudinal axis of the movable contact, characterized by:

the axis of the rotating insulator element is perpendicular to the plane of the phase-current path of the section;

the first shielding body is approximately spherical in shape and has a center lying on the axis of the rotating insulator element and also lying on the longitudinal axis of the movable contact;

the first shielding body has an interior surface and on the interior surface has at least one connection surface for receiving means for connecting with the end of the first conductor;

the mid-perpendicular of the connection surface lies in a plane of the phase-current path of the section and the enclosed housing is in a region adjacent to the first shielding body partly spherical in shape and this spherical area is concentric with the approximately spherical first shielding body.

8. A disconnect switch according to claim 7, further characterized by:

a plurality of connecting surfaces within the hollow sphere of the first shielding body set at angles relative to one another, for receiving the connecting means required for the connection with the end of the first conductor; and the mid-perpendicular of each connecting surface lies in the plane of the phase-current path of the section.

9. A disconnect switch according to claim 8, further characterized by, three of said connecting surfaces lying next to one another and making an angle of 45° with one another.

10. A disconnect switch according to claim 8, further characterized by:

the feedthrough insulator for the second conductor, having an end which is surrounded by the second shielding body, being always the same distance away from the center of the approximately spherical first shielding body regardless of which of the plurality of connecting surfaces is used to connect said first shielding body to the end of the first conductor.

11. A disconnect switch for a multi-pole section according to claim 7, further characterized by:

the multi-pole switch is a three-pole switch;

at least two of the associated disconnect-switch poles have the isolation gap oriented differently relative to the axis of the first conductor.

* * * * *